US008381492B2

(12) United States Patent
Haddad

(10) Patent No.: US 8,381,492 B2
(45) Date of Patent: Feb. 26, 2013

(54) HYGIENIC HAIR BRUSH COVER

(76) Inventor: Richard Haddad, Leesburg, VA (US)

( * ) Notice: Subject to any disclaimer, the term of this patent is extended or adjusted under 35 U.S.C. 154(b) by 225 days.

(21) Appl. No.: 12/628,213

(22) Filed: Dec. 1, 2009

(65) Prior Publication Data

US 2011/0126491 A1 Jun. 2, 2011

(51) Int. Cl.
*B65B 55/00* (2006.01)

(52) U.S. Cl. ..... 53/397; 53/441; 53/581; 53/592; 53/594; 15/257.01

(58) Field of Classification Search ..... 53/397, 53/441, 580, 581, 592, 594; 15/257.01
See application file for complete search history.

(56) References Cited

U.S. PATENT DOCUMENTS

| | | | | | |
|---|---|---|---|---|---|
| 31,727 | A | | 3/1861 | McClure | |
| 1,249,334 | A | | 12/1917 | Colchin | |
| 2,140,578 | A | | 12/1938 | Goodloe | |
| 2,553,242 | A | | 5/1951 | Dombitsky | |
| 3,227,335 | A | * | 1/1966 | Minnema et al. | 223/111 |
| 3,968,805 | A | * | 7/1976 | Sobeck, Jr. | 132/270 |
| 4,174,416 | A | * | 11/1979 | Mercer | 428/107 |
| 4,517,703 | A | | 5/1985 | Koke | |
| 4,920,974 | A | * | 5/1990 | Roth et al. | 600/572 |
| 4,941,232 | A | * | 7/1990 | Decker et al. | 16/421 |
| 5,016,388 | A | * | 5/1991 | Burress et al. | 47/32.5 |
| 5,031,277 | A | * | 7/1991 | Coker | 15/257.3 |
| 5,074,023 | A | * | 12/1991 | Decker et al. | 29/450 |
| 5,233,788 | A | * | 8/1993 | Jackson, Jr. | 47/31 |
| 5,267,860 | A | * | 12/1993 | Ingram et al. | 433/116 |
| 5,392,482 | A | * | 2/1995 | Drulias et al. | 15/104.94 |
| 5,392,591 | A | * | 2/1995 | Simpson | 53/435 |
| 5,519,912 | A | | 5/1996 | Kawamura | |
| 5,538,584 | A | * | 7/1996 | Metz | 156/294 |
| 5,600,865 | A | | 2/1997 | Morrison | |
| 5,753,861 | A | * | 5/1998 | Hansen et al. | 174/93 |
| 5,890,255 | A | | 4/1999 | Robinson | |
| 5,896,983 | A | * | 4/1999 | Wood | 206/69 |
| 5,926,902 | A | | 7/1999 | Pierre | |
| 6,021,542 | A | | 2/2000 | Norman | |
| 6,112,362 | A | | 9/2000 | Parko | |
| 6,314,185 | B1 | * | 11/2001 | Lashley | 379/452 |

(Continued)

FOREIGN PATENT DOCUMENTS

| | | | |
|---|---|---|---|
| JP | 2006043366 | A | 2/2006 |
| WO | 2005051121 | A1 | 6/2005 |

OTHER PUBLICATIONS

PCT ISR US2010/048874 Nov. 25, 2010.

*Primary Examiner* — Christopher Harmon
(74) *Attorney, Agent, or Firm* — Symbus Law Group, LLC; Clifford D. Hyra

(57) ABSTRACT

A hygienic cover for a hair brush is an elastic plastic netting of lycra polyester stitched into a tunnel shape with open and closed ends. This cover is rolled on a hollow insert with two open ends. A hairbrush is inserted into and through the insert. The closed end of the cover hits the end of the brush and the cover is stretched over the brush and slides off the insert and compresses around the brush head. The cover is porous and the holes grow when stretched, allowing the brush bristles to pass through the cover. When allowed to slide off the insert and collapse around the brush, the cover closes tightly around the bristles to prevent debris from reaching the brush head. The cover protects the brush in use. After each use, the hygienic cover can be taken off and replaced by a new cover.

18 Claims, 2 Drawing Sheets

U.S. PATENT DOCUMENTS

| | | | | |
|---|---|---|---|---|
| 6,916,301 | B1 * | 7/2005 | Clare | 602/3 |
| 2002/0069553 | A1 * | 6/2002 | March | 36/7.1 R |
| 2003/0086563 | A1 * | 5/2003 | Lashley | 379/452 |
| 2004/0133144 | A1 * | 7/2004 | Crichton | 602/62 |
| 2005/0085775 | A1 * | 4/2005 | Ostfeld et al. | 604/171 |
| 2006/0026783 | A1 | 2/2006 | McKay | |
| 2007/0100464 | A1 * | 5/2007 | Meulink | 623/23.46 |
| 2011/0005648 | A1 * | 1/2011 | Sa | 150/154 |

* cited by examiner

HYGIENIC HAIR BRUSH COVER

BACKGROUND OF THE INVENTION

The present invention relates generally to hygienic devices for hair brushes. Hair brushes readily accumulate a large quantity of hair, dandruff, and other detritus in use. Cleaning them can be a difficult and time-consuming process. For the average consumer, this can be an occasional annoyance. For a professional hair dresser, who may brush the hair of ten different people in a single day, it is a costly and frustrating necessity. After every client the brush must be thoroughly cleaned, which is can take several minutes, depending on brush type etc. If multiple brushes are used, each must be cleaned.

Over the years, various devices have been developed in an attempt to mitigate this problem. However, none have worked in a satisfactory manner. Most such devices are designed for use with one specific brush, or are unsuitable for use with a blow-dryer, or simply have unsatisfactory performance.

Needs exist for improved methods for protecting and cleaning hair brushes.

SUMMARY

It is to be understood that both the following summary and the detailed description are exemplary and explanatory and are intended to provide further explanation of the invention as claimed. Neither the summary nor the description that follows in intended to define or limit the scope of the invention to the particular features mentioned in the summary or in the description.

In certain embodiments, the disclosed embodiments may include one or more of the features described herein.

A hygienic cover for a hair brush is an elastic plastic netting of lycra polyester stitched into a tunnel shape with open and closed ends. This cover is rolled on a hollow insert with two open ends. A hairbrush is inserted into and through the insert. The closed end of the cover hits the end of the brush and the cover is stretched over the brush and slides off the insert and compresses around the brush head. The cover is porous and the holes in the cover grow when stretched, allowing the brush bristles to pass through the cover. When allowed to slide off the insert and collapse around the brush, the cover closes tightly around the bristles to prevent debris from reaching the brush head. The cover protects the brush in use. After each use, the hygienic cover can be taken off and replaced by a new cover.

A new brush hygiene apparatus includes a hygienic cover in the shape of a tunnel with one closed end and a hollow insert open at two ends. The hygienic cover is made of an elastic, porous material, and in its unstretched condition is smaller in major diameter than the hollow insert. The hygienic cover can be rolled onto the hollow insert for storage in a stretched condition and application to a brush.

In one embodiment the elastic, porous material is lycra polyester. In one embodiment, the hollow insert is made of cardboard. The shape of the hollow insert may be optimized for a particular brush such that the bristles and head of the particular brush can easily pass through the hollow center of the insert. In one embodiment, the hollow insert is in the shape of a hollow cylinder.

In one embodiment, wherein the elastic, porous material is lycra polyester, the hollow insert is made of cardboard, and the hollow insert is in the shape of a hollow cylinder.

A new brush hygiene cover applicator and storage apparatus has a hollow insert with two open ends. An elastic brush cover can be stored on the hollow insert and applied to a brush by passing the hollow insert over the brush's head.

A new brush cover method involves rolling a hygienic cover in the shape of a tunnel with one closed end onto a hollow insert that is open at two ends. In one embodiment, a brush is inserted into one open end of the hollow insert, the brush is extended through the hollow insert and out the second open end, and the hygienic cover is caught on the end of the brush, stretching the hygienic cover and pulling the hygienic cover off of the hollow insert as the brush passes through the hollow insert and collapsing the hygienic cover around bristles and a brush head of the brush.

In one embodiment, the hygienic cover is removed from the brush head. The hygienic cover that was removed from the brush head may be cleaned and placed on the hollow insert. The hygienic cover may be replaced on the brush head with a second hygienic cover. In one embodiment, the brush is used to brush hair. The hygienic cover may be discarded.

In one embodiment, a comb is inserted into one open end of the hollow insert, the comb is extended through the hollow insert and out the second open end, and the hygienic cover is caught on the end of the comb, stretching the hygienic cover and pulling the hygienic cover off of the hollow insert as the comb passes through the hollow insert and collapsing the hygienic cover around teeth and a body of the comb.

In one embodiment the hygienic cover is made of lycra polyester. In one embodiment the hollow insert is made of cardboard. In one embodiment the hollow insert is in the shape of a hollow cylinder. In one embodiment, the brush is used to brush hair while a blow-dryer is used on the hair.

These and other objectives and features of the invention are apparent in the disclosure, which includes the above and ongoing written specification.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art.

DETAILED DESCRIPTION

Figure 1:
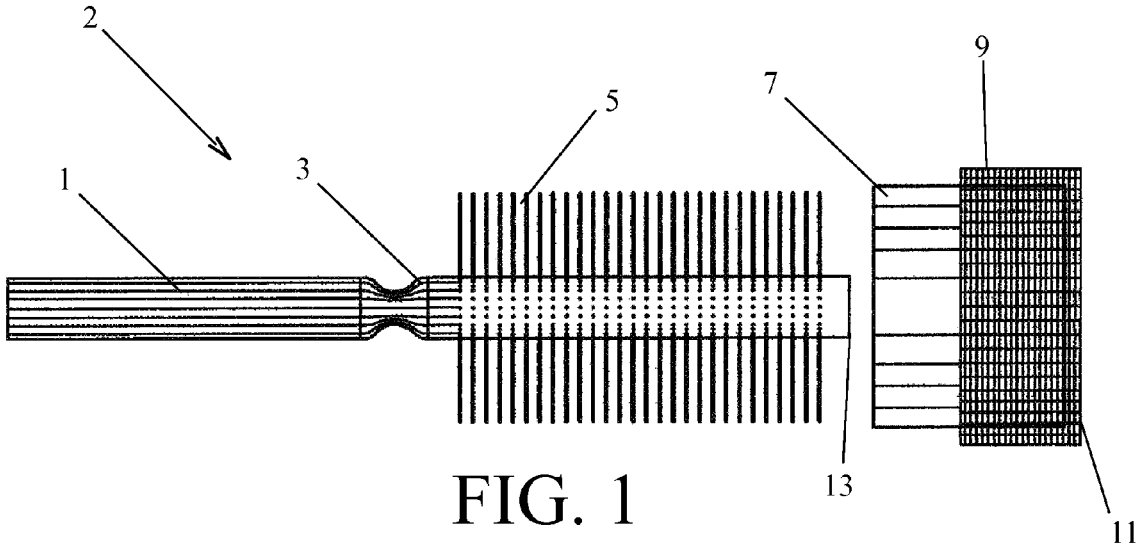
FIG. 1 is a diagram of a hygienic brush cover with insert and cylindrical hair brush.

An improved hygienic hair brush cover will now be disclosed in terms of various exemplary embodiments. This specification discloses one or more embodiments that incorporate features of the invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail.

FIG. 1 shows a cylindrical hair brush 2 with handle 1 and head 3, on which bristles 5 are attached in a 360 degree configuration. A flexible hygienic hair brush cover 9 is rolled on a hollow cardboard insert 7, which is adjacent to the brush in preparation for application of the cover. The flexible hygienic hair brush cover is close on one end 11 and open on the other.

Figure 2:
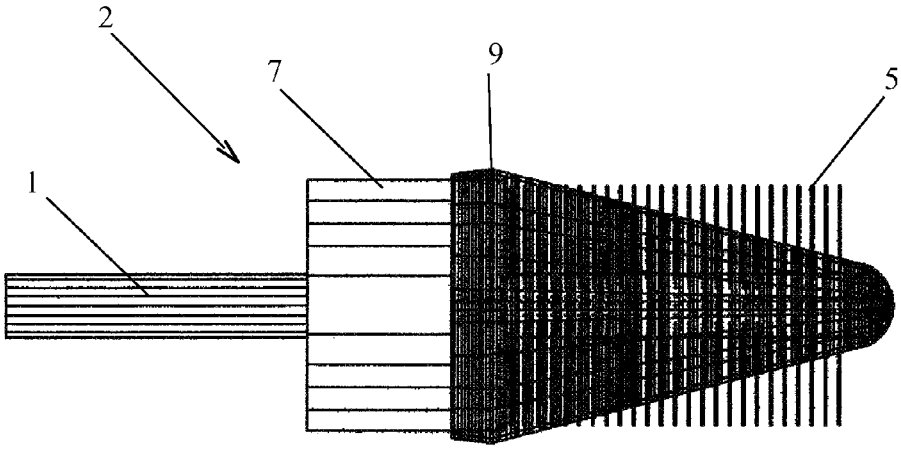
FIG. 2 is a diagram of a hygienic brush cover being applied to a cylindrical hair brush.

FIG. 2 shows a cylindrical hair brush 2 midway through application of the cover 9. Hollow cylindrical insert 7 has been passed over the brush head 3 (not visible), catching the closed end of the flexible hygienic hair brush cover 9 on the end of the brush 13 and stretching it and pulling it off the end of the insert 7. As the flexible hygienic hair brush cover 9 is stretched, its pores become larger and pass over brush bristles 5, contracting towards the center of the brush 2. At this stage in the application, the flexible hygienic hair brush cover is stretching but has not been completely pulled off of the hollow insert 7, which has yet to pass over the brush handle 1 and off of the brush. Note that alternatively, the brush could be inserted in the other end of the insert 7, first hitting the closed end of the flexible hygienic brush cover 9 and exiting the open end, to achieve the same result.

Figure 3:
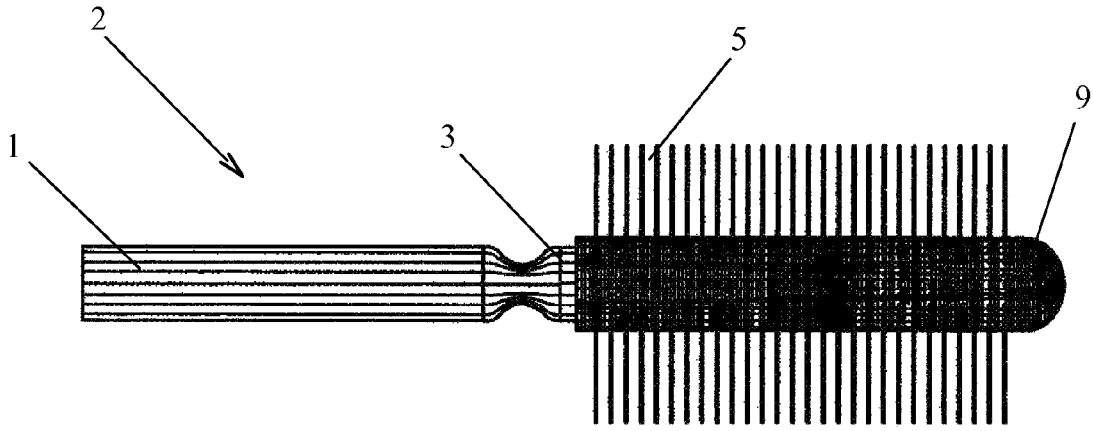
FIG. 3 is a diagram of a cylindrical hair brush with a hygienic brush cover applied to it.
Figure 4:
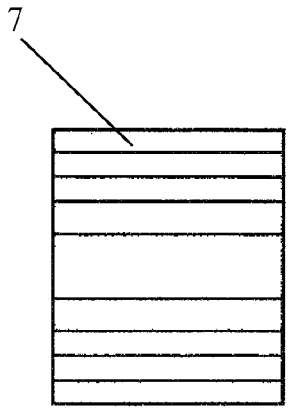
FIG. 4 is a diagram of an insert.

FIG. 3 shows the cylindrical hair brush 2 after the flexible hygienic hair brush cover 9 has been applied. As the hollow insert 7 is passed over the brush handle 1, the flexible hygienic hair brush cover 9 is stretched until enough tension is generated that the open end slips off the edge of the hollow insert 7, allowing the entire flexible hygienic hair brush cover 9 to contract back towards its unstretched size, collapsing around and down the brush bristles 5 towards the brush head 3.

In its unstretched state the flexible hygienic hair brush cover 9 is tight around the brush bristles 5, acting as an essentially solid barrier to prevent passage of detritus through to the brush head 3. At this point, the brush bristles 5 are substantially exposed and the brush can be used as normal to brush hair, with the flexible hygienic hair brush cover 9 posing no obstacle. Hair, dandruff, and other debris accumulates on the flexible hygienic hair brush cover 9, rather than the brush 2, and the flexible hygienic hair brush cover 9 can be easily removed as necessary for hygiene purposes by stretching and pulling the cover 9 off the brush 2.

A hygienic cover for a hair brush is an elastic plastic netting of lycra polyester (pantyhose) stitched into a condom-like tubular shape with one open end and one closed end. In one embodiment, the hygienic cover material is a combination of lycra polyester and cotton, which reduces static build-up. The elastic material is kept rolled on a compact hollow cylindrical cardboard paper insert that prevents the cover from collapsing completely into its unstretched form when not in use.

To use the hygienic cover, a hairbrush is inserted into the cardboard insert and the cardboard insert is passed along the length of the hairbrush and off of it. As the insert passes over the brush, the closed end of the hygienic cover hits the end of the brush and the hygienic cover is stretched over the brush. When the cover is fully stretched, it comes off of the insert and compresses around the brush head. The cover is porous and the size of the holes grow when it is stretched, allowing the brush head bristles to stay standing up and pass through it. When allowed to slide off of the insert and collapse around the brush head, the hygienic cover closes tightly around the brush bristles to prevent passage of any debris through to the brush head.

The brush is then used with the hygienic cover on. The hygienic cover protects the brush from accumulation of hair, dandruff, etc. After each use, the hygienic cover can be taken off and replaced by a new cover. The old cover can be cleaned or discarded. Ordinarily, brushes have to be cleaned after every client, which is very time consuming. In contrast, the hygienic cover can be replaced in seconds. If necessary, the top of the bristles can be cleaned very quickly as well.

The hygienic cover is elastic and can accommodate varying brush sizes and shapes, including flat and cylindrical brushes, as well as combs, but comes in several sizes to better fit very small or large brushes. It also comes in different shapes, for optimal ease of application and fit on atypical brushes, and can be used for all kinds of brush applications including human and animal grooming. The cross section of the hygienic cover is typically circular or elliptical, but could be any shape (e.g. triangular) if suitable for a given brush head. It comes in different colors for decoration or to match the appearance of the brush.

Similarly, the hollow insert is in a shape with a large enough opening to be used with a variety of different brushes. However, for ease of application and storage, different inserts are made in a variety of shapes and sizes optimal to certain types of brushes.

Critically, the hygienic cover can be used during blow drying and does not melt under the heat or conduct the heat to a client's scalp or hair, as other plastic or metal materials are prone to do. Even a blow dryer with a concentrator does not melt the cover. The cover does not conduct heat the way metal does and actually insulates the client to some extent from the blow dryer heat. The cover also makes the brush less staticy, improving the client experience and ease of brushing.

The invention is not limited to the particular embodiments described above in detail. Those skilled in the art will recognize that other arrangements could be devised, for example, various cover and insert materials and shapes for various applications in hair styling, animal grooming, or other applications involving concern for hygiene or contamination and passing of protrusions through foreign materials. While the invention has been described with reference to specific illustrative embodiments, modifications and variations of the invention may be constructed without departing from the scope of the invention.

I claim:

1. A brush hygiene apparatus, comprising:

a hygienic cover in the shape of a tunnel with one closed end, and a rigid hollow insert open at two ends, wherein the hygienic cover is made of an elastic, porous material, and in its unstretched condition is smaller in major diameter than the hollow insert, wherein the hygienic cover is rolled onto the outer surface of the hollow insert in a stretched condition prior to application to a brush, wherein the hygienic cover and hollow insert are configured such that, when the hygienic cover is rolled onto the outer surface of the hollow insert and a hair brush is passed through the hollow insert, the hair brush pulls the hygienic cover off the hollow insert and onto the hair brush, collapsing the hygienic cover around the hair brush head in a stretched condition with bristles of the hair brush extending through the hygienic cover.

2. The brush hygiene apparatus of claim 1, wherein the elastic, porous material is spandex polyester.

3. The brush hygiene apparatus of claim 1, wherein the hollow insert is made of cardboard.

4. The brush hygiene apparatus of claim 1, wherein the shape of the hollow insert is optimized for a particular brush such that the bristles and head of the particular brush can easily pass through the hollow center of the insert.

5. The brush hygiene apparatus of claim 1, wherein the hollow insert is in the shape of a hollow cylinder.

6. The brush hygiene apparatus of claim 1, wherein the elastic, porous material is spandex polyester, the hollow insert is made of cardboard, and the hollow insert is in the shape of a hollow cylinder.

7. A hygienic brush cover method, comprising:

rolling a hygienic cover in the shape of a tunnel with one closed end onto a rigid hollow insert that is open at two ends, wherein the hygienic cover is made of an elastic, porous material, and in its unstretched condition is smaller in major diameter than the hollow insert, inserting a brush into one open end of the hollow insert with the hygienic cover rolled on it, extending the brush through the hollow insert and out the second open end, and in so doing catching the hygienic cover on the end of the brush, stretching the hygienic cover and pulling the hygienic cover off of the hollow insert as the brush passes out the second open end and through the hollow insert, and collapsing the hygienic cover around bristles and a brush head of the brush.

8. The method of claim 7, further comprising removing the hygienic cover from the brush head.

9. The method of claim 8, further comprising cleaning the hygienic cover that was removed from the brush head and placing it on the hollow insert.

10. The method of claim 7, further comprising using the brush to brush hair.

11. The method of claim 8, further comprising replacing the hygienic cover on the brush head with a second hygienic cover.

12. The method of claim 11, further comprising discarding the hygienic cover.

13. The method of claim 7, further comprising inserting a comb into one open end of the hollow insert, extending the comb through the hollow insert and out the second open end, and catching the hygienic cover on the end of the comb, stretching the hygienic cover and pulling the hygienic cover off of the hollow insert as the comb passes through the hollow insert and collapsing the hygienic cover around teeth and a body of the comb.

14. The method of claim 7, wherein the hygienic cover is made of spandex polyester.

15. The method of claim 7, wherein the hollow insert is made of cardboard.

16. The method of claim 7, wherein the hollow insert is in the shape of a hollow cylinder.

17. The method of claim 7, further comprising using the brush to brush hair while using a blow-dryer on the hair.

18. The method of claim 10, further comprising using the brush to groom an animal.

* * * * *